United States Patent [19]

Tong

[11] Patent Number: 4,769,049

[45] Date of Patent: Sep. 6, 1988

[54] SIDE RAPPING DRAG HAMMER APPARATUS FOR ELECTROSTATIC PRECIPITATORS

[75] Inventor: John R. Tong, Pickerington, Ohio

[73] Assignee: United McGill Corporation, Groveport, Ohio

[21] Appl. No.: 38,055

[22] Filed: Apr. 14, 1987

[51] Int. Cl.[4] ..... B03C 3/76

[52] U.S. Cl. ..... 55/112; 55/145; 55/146

[58] Field of Search ..... 55/112, 145, 146, 300; 173/94, 100, 101

[56] References Cited

U.S. PATENT DOCUMENTS

| | | | |
|---|---|---|---|
| 1,286,458 | 12/1918 | Warren | 55/300 |
| 2,196,839 | 4/1940 | Seng | 55/300 |
| 2,668,600 | 2/1954 | Wintermute | 55/112 |
| 3,183,648 | 5/1965 | Lagerdahl | 55/112 |
| 3,487,606 | 1/1970 | Bridges et al. | 55/112 X |
| 3,570,217 | 3/1971 | Steuernagel | 55/112 |
| 3,844,742 | 10/1974 | Petersen | 55/112 |
| 3,958,962 | 5/1976 | Hayashi . | |
| 4,056,372 | 11/1977 | Hayashi . | |
| 4,057,405 | 11/1977 | Cheney et al. | 55/112 X |
| 4,353,718 | 10/1982 | Franzen et al. | 55/112 |
| 4,381,927 | 5/1983 | Noll . | |
| 4,502,870 | 3/1985 | Wheeler | 55/112 X |
| 4,519,817 | 5/1985 | Gibbons | 55/112 |

FOREIGN PATENT DOCUMENTS

| | | | |
|---|---|---|---|
| 721846 | 1/1955 | United Kingdom | 55/112 |

*Primary Examiner*—Kathleen J. Prunner

*Attorney, Agent, or Firm*—Nies, Webner, Kurz & Bergert

[57] ABSTRACT

An electrostatic plate type precipitator is provided with plural alternately disposed, vertically arranged, and equally spaced apart discharge and collector plates in a housing support structure with an inlet and outlet, enabling passage of gases between the plates, the discharge plates and the collector plates being electrically insulated from each other. An elongate drag hammer assembly, for each of the set of collector plates and the set of discharge plates, extends through the plates normal to their parallel planes. Each drag hammer assembly includes a drag rod and a plurality of pivotally hanging hammers mounted along the drag rod. Tracks mount the drag rods for reciprocation back and forth relative to the plates to move the hanging hammers past a selected number of the associated plates. Abutment ledges integral with the plates cooperate with associated hammers to move each hammer upward about its pivot as it moves past a plate whereupon the raised hammer is permitted to fall and impact the next adjacent plate. The discharge plate drag hammer assembly is mounted in electrical isolation from the collector plates, the housing support structure and the other drag hammer assembly. The collector plate drag hammer assembly is mounted in electrical isolation from the discharge plates. Both drag rods are power driven to slowly reciprocate the drag rods and the hammers. Each hammer will sequentially impact (rap) and clean more than one of successive plates. The drag rods can be one integral rod or a plurality of aligned joined segments.

31 Claims, 4 Drawing Sheets

SIDE RAPPING DRAG HAMMER APPARATUS FOR ELECTROSTATIC PRECIPITATORS

BACKGROUND OF THE INVENTION

This invention relates to improved rapping apparatus for plate type electrostatic precipitators. More particularly the novel invention relates to a rapping apparatus wherein the collector and discharge plates are rapped from the sides of the plates by a multiplicity of hanging, pivotal mounted hammers which are dragged past the plates and caused by interaction with the plates to be raised and then permitted to swing down in an arc to impact the side of an adjacent plate.

Precipitators to which this invention pertains are commercial plural plate precipitators used in factories and similar environment to collect and remove dust and other debris from exhaust gases, e.g., from power plants and industrial processes, to prevent discharge of such pollutants into the atmosphere. The exhausting gases pass between and parallel to a plurality of plates, alternate ones (discharge plates) of which are highly charged and the others (collector plates) being normally grounded. In a well-known manner, dust, debris and other pollutants are collected on the plates and the essentially cleaned gases pass on to the atmosphere, e.g., up a stack. In operation the pollutants build up on the plates and cause a decrease in efficiency. In accord with prior art teaching the plates are periodically rapped or struck with hammers to remove the collected material which drops into hoppers below the precipitator. The rapping mechanism in prior art devices are either edge rappers or side rappers.

Several examples of edge rappers are found in U.S. Pat. Nos. 2,668,600 to H. A. Wintermute; 3,570,217 to W. Steuernagel; and 3,844,742 to H. H. Petersen. A rapping mechanism which incorporates hammers acting on anvils connected to plates is shown in U.S. Pat. No. 4,519,817 to R. E. Gibbons and a beater type with swinging whips on a reciprocating bar used on a filter is shown in U.S. Pat. No. 2,196,839 to L. E. Seng.

Edge rappers are not proven to be particularly effective in generating the requisite vibratory forces in the plate for effecting dislodging of the collected material. There are some prior art side rappers which create hammer blows at the same time to all of the collector plates or all of the discharge plates during one reciprocation of the hammer carriers. While such side rapping constructions provide an effective force against the plates to dislodge the collected material, because 50% of the plate surfaces within the precipitator module are cleaned at one time, the result is a visible emission from the stack each time the plates are rapped.

The problems attending side rapping have existed for many years and prior efforts to reduce the number of plates cleaned at one time have not been successful.

SUMMARY OF THE INVENTION

To resolve the problem existing in prior art side rappers and still retain the efficient rapping force which is obtained by side rapping, this invention provides a structure which can effectively and satisfactorily clean a very small percentage of the total number of plates, e.g., one plate at a time in sequence, in an operating precipitator, and will prevent visible emission from the stack caused by puffing when the plates are rapped.

The present invention was developed for use on precipitators of the kind disclosed in U.S. Pat. Nos. 3,958,962 and 4,056,372 to T. Hayashi and 4,381,927 to C. G. Noll, which teach structure including a plurality of alternating discharge plates and collector plates, the discharge plates having corona discharge needles along their vertical edges. In the past, precipitators built in accord with the teachings of these patents have incorporated a side rapping technique in which a plurality of reciprocated hammers rap all discharge plates at one time and another set of reciprocated hammers rap all collector plates.

The invention provides that the collector plates are cleaned by a series of pivotally hanging hammers dragged through apertures in the plates and falling onto and cleaning the next adjacent collector or discharge plate. Each hammer is used to sequentially rap and clean more than one of successive discharge or collector plates, e.g., four plates. The series of hammers are mounted on a tubular rod or pipe which projects laterally through the precipitator plates, slidable within a fixed square tube track having a continuous slot in the bottom which allows clearance for the hammer pivot hangers.

For the collector plate drag hammer arrangement, the square tube can be mounted to the collector plates or to grounded precipitator support structure such as the end walls of the housing.

The discharge plates, which are high voltage charged, are cleaned with a similar hammer arrangement except that the square tube is suspended from each high voltage plate by means of a suitable hanger arrangement, thereby supporting the weight of the hammer tube assembly. The linear thrust which is imparted to the square tube by the traveling pipe inside is restrained by the use of a fixed high voltage insulator mounted outside the gas stream. The traveling pipe has a moving high voltage insulator on one end, outside the gas stream, to provide high voltage isolation. The isolation of the entire discharge hammer system, although high voltage charged, from the grounded structure by the two insulators, enables use of steel hammers to rap the discharge plates.

Both the collector and discharge plate moving hammer pipes are connected at one end to a single air cylinder, located outside of the gas stream which passes through the precipitator. The falling hammers, each of which, e.g., clean four plates in succession, are spaced a distance apart equal to the spacing of every four plates *plus* one inch. This allows only one hammer to fall at a time as the air cylinder motor slowly completes its forward stroke and then the hammer operation is repeated as the motor retracts to its rest position, with the desirable result being that only one of a group of the plates, e.g., a group of 20 collector plates, in a precipitator is rapped and cleaned at any one time.

Constructing the drag hammer tubular rod in segments enables quick convenient servicing of the hammer assemblies as will become apparent.

A primary object of the present invention resides in providing a rapping hammer assembly in which a series of hammers are pivotally hung from a reciprocable rod or tube which passes laterally through an intermediate zone of all plates in a plate type electrostatic precipitator and wherein each hammer is carried by the rod in predetermined positions along its length so that as the rod is reciprocated in one direction each hammer successively will be dragged over the edge of an aperture in a selected number of collector or discharge plates until it falls free and swings in an arc to strike the next one of the plates associated with that specific hammer and that only one hammer of the series of hammers will strike or rap a plate at a single instant during the full stroke of the rod and the sequential rapping is repeated in reverse during the return stroke of the rod.

Two sets of such a series of hammers with associated reciprocating rod and track are provided, one for the collector plates and one for the discharge plates. The structural relationship between the plates and each set of a series of the hammers and their rod is arranged so the track, rod and hammers of the set for rapping the collector plates pass through large apertures in the discharge plates with desired clearance from and without contacting the high voltage discharge plates and the reverse is true of the rod and series of hammers used to rap the high voltage discharge plates, i.e., they have desired clearance from and do not contact the collector plates.

The rod associated with the discharge plates along with the track and structure for that rod is electrically isolated from the grounded structure of the precipitator by insulators, the rod being connected via such an insulator with a reciprocating component of an air cylinder motor. That same reciprocating motor component can be directly connected to the rod, which with its series of hammers, is associated with the collector plates, so that a single motor can be used to reciprocate both of the two series of hammers. By suitable predetermined mounting location of each hammer, it can be arranged that only one plate of all plates will be rapped at a single time.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings, in which.

DESCRIPTION OF THE PREFERRED EMBODIMENT

Figure 1:
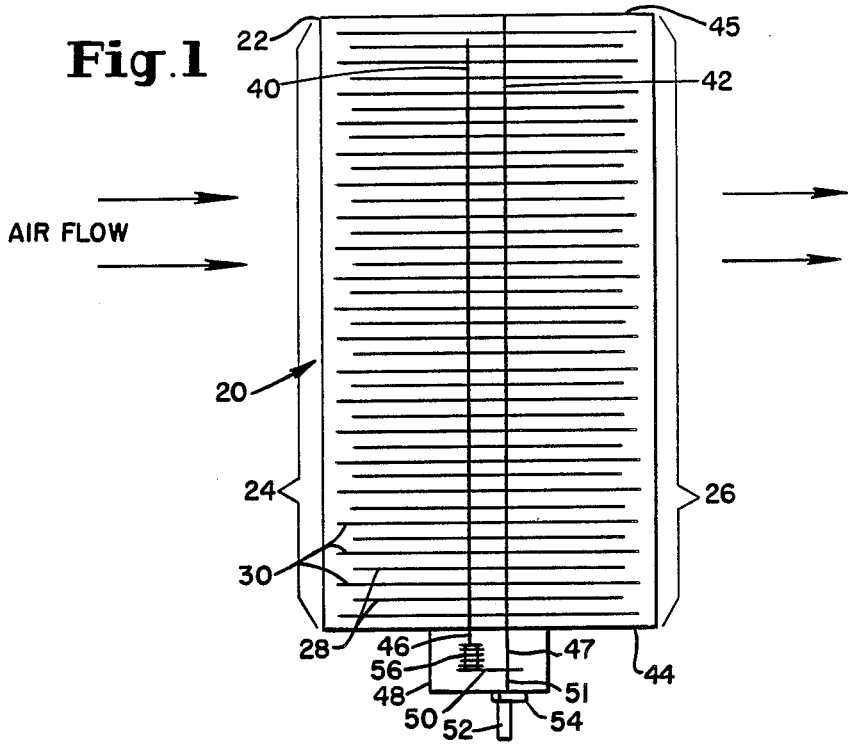
FIG. 1 is a diagramatic sketch, in horizontal section which shows the basic inventive arrangement of two drag hammer assemblies, with motor drive, mounted normal to and through the collector and discharge plates of a commercial electrostatic precipitator.
Figure 2:
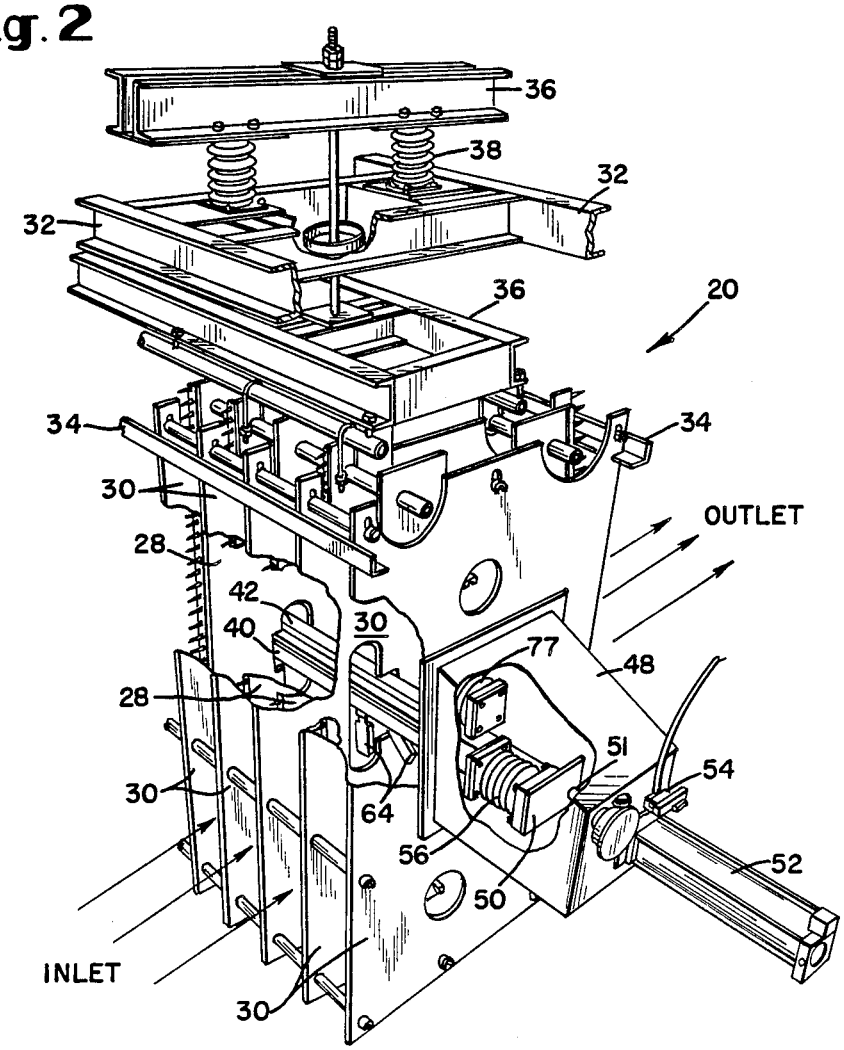
FIG. 2 is a perspective sketch of a detailed portion of an electrostatic precipitator, partially broken away to show the general arrangement of the rapping drag hammer apparatus of this invention.

In the drawings, FIGS. 1 and 2 illustrate the relationship of the rapping drag hammer assemblies in accord with the present invention with elements of a commercial plate type electrostatic precipitator, basic parts of which, excepting for the drag hammer assemblies, are essentially similar to prior art precipitators components. Such prior art components will be only briefly described but a more comprehensive understanding of such plate type precipitators can be found, if desired, in the aforementioned U.S. Pat. Nos. 3,958,962; 4,056,372; and 4,381,927.

FIG. 1 is a diagramatic view showing an electrostatic precipitator 20, and FIG. 2 shows part of such a precipitator 20, which for convenience can be referred to as an EP, including a housing 22, with an air flow inlet 24 at the left side and its outlet 26 at the right side. A plurality of parallel vertically spaced apart plates are mounted in the housing 22 providing parallel air flow paths through the EP from its inlet to the outlet. The plates consist of alternating high voltage plates 28, discharge plates, and grounded collector plates 30. A conventional such EP arrangement is designated as a module and may include twenty or more collector plates with a discharge plate midway between each of two adjacent collector plates. The discharge plates carry a high DC voltage, and the collector plates are normally at ground potential, so the two sets of plates are electrically isolated. The collector plates 30 are mounted to the precipitator frame structure, several beams 32 and braces 34 being seen in the detail view of FIG. 2, and the discharge plates are hung from an insulated support structure 36, which via insulators 38 is supported on the EP frame structure 32. The EP component, as just described, is commercially available and is made from steel, the walls being heavy steel plate and the discharge and collector plates being made from steel plate, thickness of which is normally in the order of 3/16" (i.e. approximately 5 mm.). The spacing between the collector and discharge plates can vary depending upon the installation but in a representative EP the spacing between the adjacent plates may be $2\frac{1}{2}$ inches or approximately 64 mm.

As polluted gases flow through the discharge and collector plates, through an ionization process the pollutant particles in the gases are charged and caused to collect on the collector plates and on the discharge plates. At periodic intervals the plates are rapped, impacted with some type of hammer arrangement, to cause the plates to be jarred and are thus vibrated to knock off the dust and particles which build up. The dust and particles fall downward into a hopper located at the bottom of the EP housing and then are conveyed away for disposition. However, each time one or more plates is rapped a small cloud of dust is generated in the air flow passage adjacent the plate. If a large number of plates are rapped simultaneously a substantial dust cloud is generated and is carried out of the EP outlet and up the stack and can be seen as a visible emission. It is to eliminate such large amounts of puffing caused by rapping that the present inventive drag hammer structure is proposed.

Shown very diagramatically in line depiction in FIG. 1, the rapping structure is illustrated as including two elongate rapping assemblies 40 and 42, passing from the front wall 44 of the EP normal to and through the plates 28 and 30 to a location at or adjacent the rear EP housing wall 45. The rapping drag hammer assembly 40 is the discharge plate drag hammer and the other assembly 42 is the collector plate drag hammer assembly. The elongate drive rods 46 and 47 which can be called drag rods of the respective assemblies 40 and 42 are spaced apart laterally and project through the EP housing front wall 44 into a drive motor connector housing 48 which is secured as by welding to the EP housing. Both of the drive rods 46 and 47 are connected at their front ends to a common heavy bracket connector 50 which in turn is connected to the piston shaft 51 of a dual direction pneumatic reciprocated motor 52 rigidly secured to a wall of the drive connector housing 48. The motor 52 has its shaft parallel with and essentially centered between the axes of the two drive rods 46 and 47, so that back and forth reciprocation of the motor shaft will drive the two drag hammer rods in one direction and then in the reverse direction. The motor direction of movement is sequentially reversed by a solenoid valve 54 controlled through an EP control system not disclosed nor part of the invention herein. Because the entire discharge rapping hammer assembly, including the drive rod 46 is highly charged, and as will be described, is maintained completely out of engagement with the grounded components of the EP, the front end of the rod 46 is secured to a heavy duty insulator link 56 which in turn is rigidly secured to the drive connector bracket 50.

Figure 3:
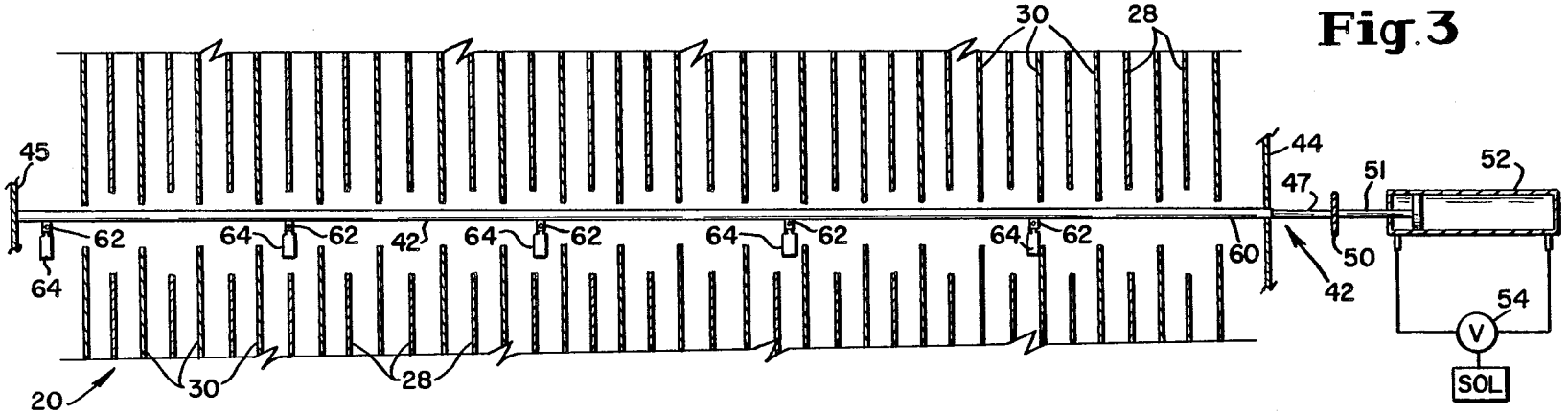
FIG. 3 is a detailed, diagramatic view, on a vertical plane, through an electrostatic precipitator depicting part of the collector and discharge plates and shows part of the series of collector plate rapping drag hammers, spaced apart a predetermined distance along the track of a reciprocable drive rod.

FIG. 3, is a diagramatic vertical section from front to back of an EP as shown in FIG. 1 showing in somewhat more detail the arrangement of the collector plate rapping hammer assembly 42 relative to the entire group of discharge and collector plates 28 and 30. The discharge hammer assembly is essentially identical and the differences will be disclosed and described hereinafter. Rod 47 projects into a square tube slotted track 60 which extends through openings in all plates and is secured rigidly at its front and rear ends as by welding, e.g., to the front and rear walls 44 and 45 of the EP housing. At spaced intervals along the rod 47, hammer hangers 62 are rigidly secured and each includes a pivot connection link extending downward through the slotted track and each pivotally carries a rapping hammer 64 (see FIGS. 5, 7 and 8). Four hammers 64 are illustrated in FIG. 3 and each is spaced from the preceding one, a distance equal to the spacing between four collector plates plus a short distance, e.g., one inch (approximately 25 mm.). If twenty collector plates are used, five (5) hammers will be used. The stroke of the motor will be a distance which will reciprocate each hammer sequentially past and over the ledge portion of the cutout in a collector plate until it swings free and falls in an arc to impact the face of the next collector plate. The end collector plates receive one impact for each back and forth reciprocation stroke of the motor whereas all other collector plates receive an impact during both of the back and forth strokes.

The discharge plate rapping hammer assembly 40 is constructed in essentially the same manner as is the assembly 42 shown in FIG. 3 excepting that its square tube slotted track 61 is constructed and mounted in a different manner, as will be described hereinafter, to assure electrical isolation from all grounded components of the EP (see FIGS. 6*a* and 10–12). By locating the hammers on the discharge hammer rod 46 at the same longitudinal distance along the rod as are the hammers of the collector hammer rod 47, one collector plate and one discharge will be rapped at any one time. However, instead of having the hammers side by side, the location of the entire rod 46, with its discharge rapping hammers spaced along the rod the same distance as are the collector rod drag hammers along rod 47, can be longitudinally offset a slight distance so the discharge hammers swing to impact the associated discharge plate at a time intermediate to the impacts imparted to successive collector plates. In this predetermined arrangement, one can design the operation so that only one plate of all plates are impacted at any one time.

Note, a plural grouping of aligned EP modules can be assembled, with through flow of gases, to construct a larger capacity EP with multiples of the collector and discharge plates in each module. In such an arrangement, the hammer rods and tracks can be increased in length to project through the parallel plates of all aligned modules and all of the rods of the rapping rod assemblies can be actuated by a single reciprocating motor.

Figure 4:
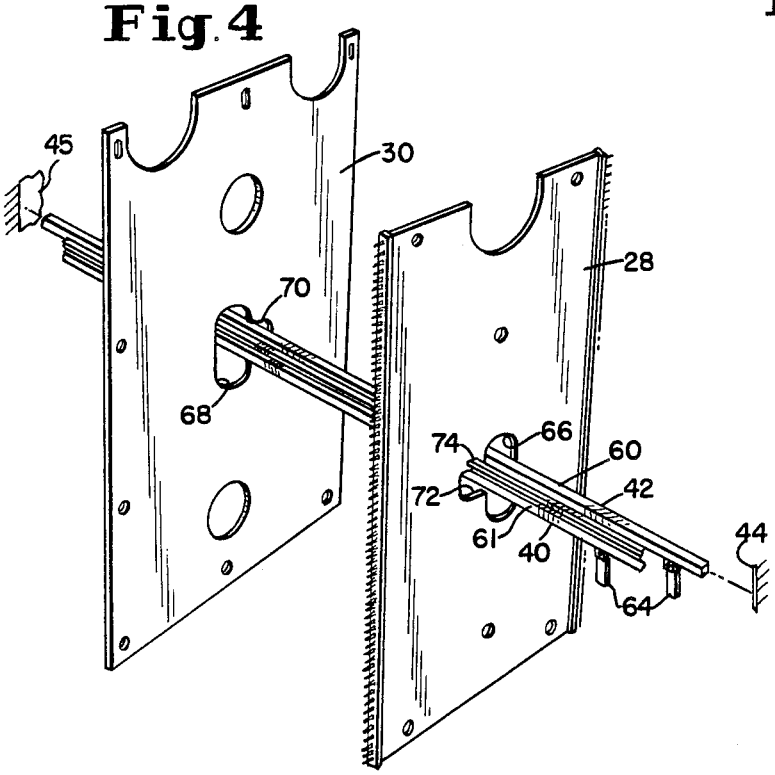
FIG. 4 is an exploded perspective view showing a collector plate and a discharge plate and illustrates how the plates are apertured to enable the drag hammer rods and tracks to pass through the plates and to provide the structural relationships between the hammer assemblies and the two kinds of plates to enable satisfactory operation of components.
Figure 12:
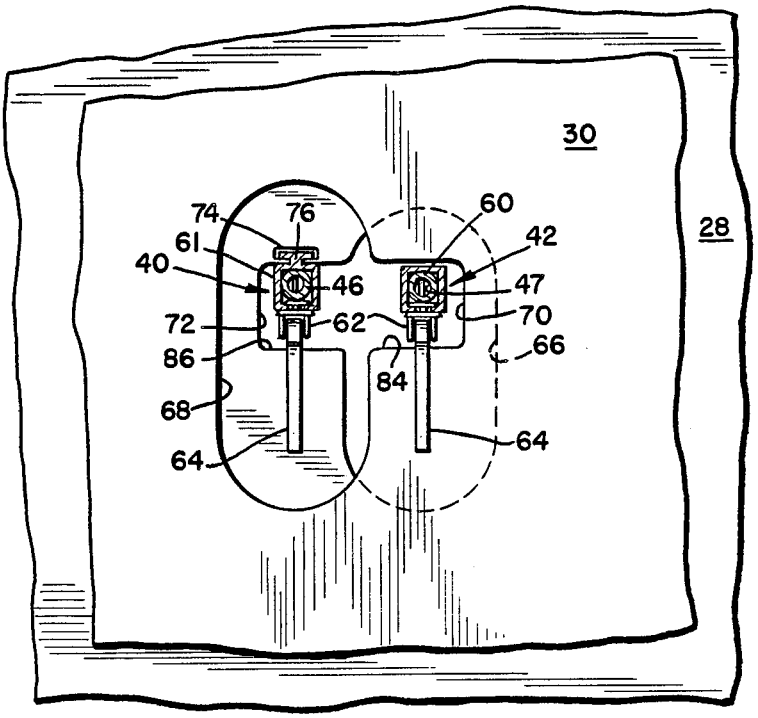
FIG. 12 is an enlarged detailed section view taken on line 12—12 of FIG. 9 to show the shapes of the holes or aperture in the discharge and collector plates through which both drag hammer, rod and track assembly project.

FIG. 4 illustrates a diagramatic detailed depiction of one collector plate 30 and one discharge plate 28 together with portions of the two rapping rod drag hammer assemblies 40 and 42. This view shows how the rapping assemblies project through an aperture or hole 66 in discharge plates 28 and 68 in collector plates 30, near the vertical and horizontal centers of the plates. All of the collector plates 30, as seen in FIG. 12, have a hole 68 which is shaped as an upright rectangular opening with rounded corners and having a lateral cutout 70 extending from the right side. All of the discharge plates 28 have a hole 66 which is also shaped as an upright rectangular opening with rounded corners and having a lateral cutout 72 extending from its left side. When all of the plates 28 and 30 are mounted in the precipitator, collector plate holes 68 will be in alignment and the discharge plate cutouts 72 will be aligned with an upper portion of the path through the collector plate holes 68. Similarly, to the right of the path through holes 68, the holes 66 in the discharge plates 28 are in alignment and the collector plate cutouts 70 will be aligned with an upper portion of the path through the discharge plate holes 66.

After the EP plates are assembled in the EP housing, the track 60 for the collector plate drag hammer assembly 42 is introduced from one face of the precipitator through all plates and is rigidly secured in a desired disposition, to be described, by suitable connections, e.g., welding to EP frame structure such as front and rear walls.

Figure 10:
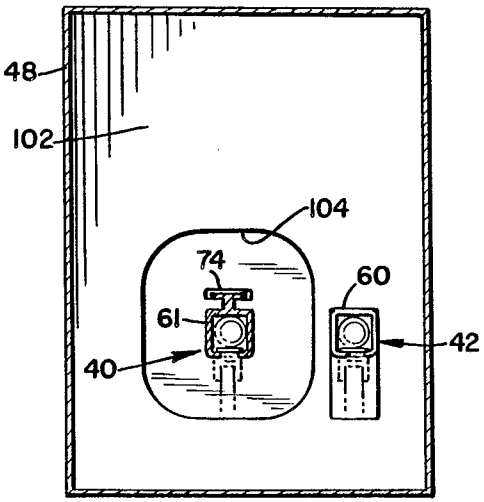
FIG. 10 is a detailed section view taken on lines 10—10 of FIG. 9.
Figure 9:
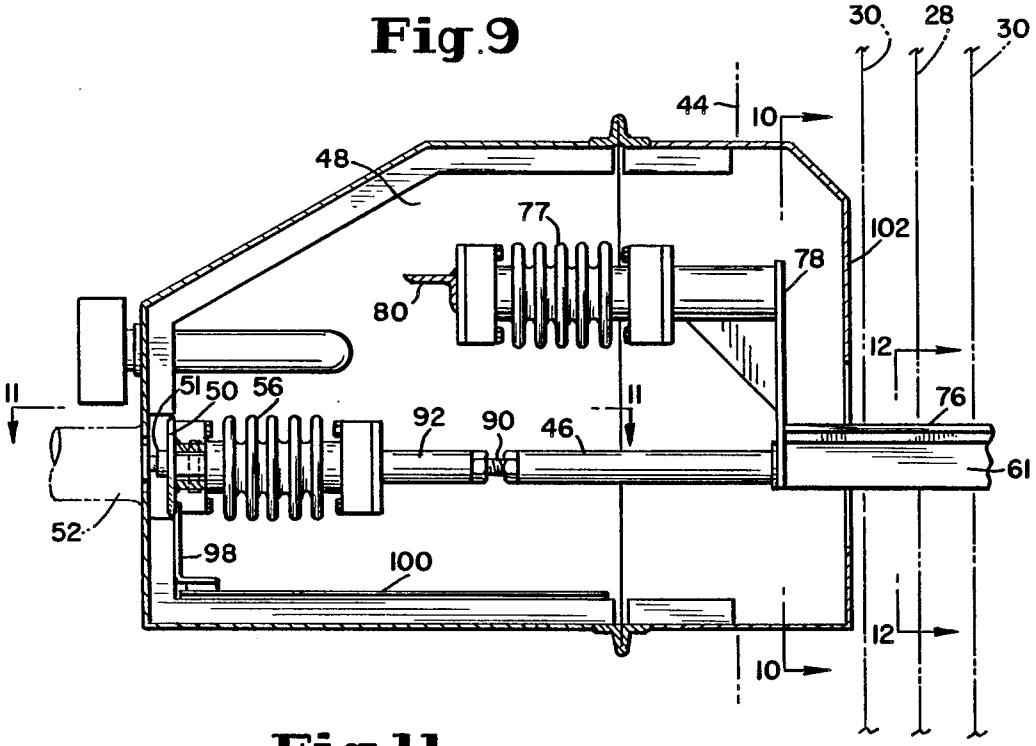
FIG. 9 is a vertical section view through the rapper rod drive connection housing showing details of the insulated support and drive connections for the discharge plate drag hammer assembly.
Figure 11:
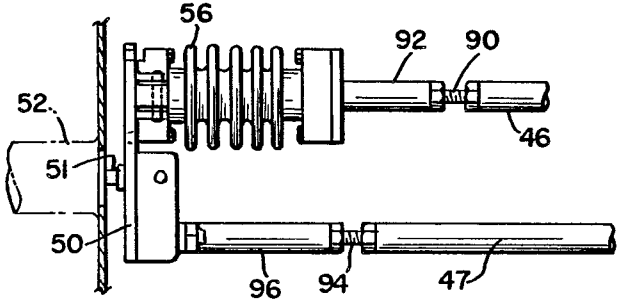
FIG. 11 is a detailed partial section taken on line 11—11 of FIG. 9 showing the mounting of both drag hammer rods to the motor drive connection.

The left hand cutouts 72 of the discharge plate holes have a T-slot formation 74 cut in the top horizontal edge. The track 61 of the discharge plate drag hammer assembly 40 incorporates a similar slotted square tube track as that used for the collector plate hammer assembly 42, excepting that a T-channel strip 76 extends along the top of the square tube track 61 and is secured thereto as by welding. The cross section profile of the T-strip 76 is sufficiently smaller than the T-slots 74 in the discharge plate cutouts 72 so that the T-channel 76 of track 61 will pass through the aligned T-slots 74 with a free sliding fit when the discharge hammer assembly track 61 is introduced through the plates. Thus the track 61 is supported vertically and laterally from the discharge plates by the interengagement of the T-channel 76 and T-slots 74 and will be in electrical conductivity with the discharge plates. As shown in FIGS. 9, 10 and 11, the front end of track 61 projects into the drive connection housing 48 and via a rigid bracket 78 is fastened to one end of isolation insulator 77, the other end of which is secured to the EP support structure via a rigid angle bracket 80. This support structure and the fixed insulator 77 secures the discharge assembly track 61 in a fixed axial disposition relative to the plates through which the track 61 passes and from which it hangs by the T and T-slot arrangement, and track 61 is thus insulated from the EP ground frame structure.

Collector plate holes 68 must be dimensioned so that the discharge hammer assembly 40, including the square tube track 61 and T-channel and hanging hammers 64 will freely pass through the collector plate openings 68 without contact and with clearance between all components of the assembly 40 and the edges of the collector holes sufficient to assure no electrical arcing from the highly charged discharge hammer assembly to the grounded collector plates, the clearance always being at least equal to the design spacing between adjacent discharge and collector plates, e.g., if plates are spaced 2½ inches (approximately 64 mm.) apart, then the clearance should always be at least the same dimension. The same clearance relationship will be necessary between the components of the collector hammer assembly 42 and the discharge plate holes 66 to assure no electrical arcing from the highly charged discharge plates 28 to the grounded collector hammer assembly 42.

FIG. 12 illustrates that the lateral cutouts 70 and 72 in the holes 68 and 66 of the collector and discharge plates 30 and 28 respectively, have a lower horizontal edge 84 and 86 respectively which, when the drag hammer assembly is mounted will be located just below the bottom of the reciprocating path of the hammer hangers 62. Those edges constitute abutment ledges over which a hammer is dragged during reciprocation of the drive rods 46,47 causing the hammer to be pivoted upward until it is essentially horizontal and its bottom passes the edge 84 or 86, whereupon the hammer will swing by gravity down in an arc to impact the next adjacent plate of the series of discharge plates or of the series of collector plates. As a discharge hammer falls down in its swinging arc it will swing through the adjacent hole 68 of the adjacent collector plate, and the hammer length is predetermined so that when it reaches the bottom of its arc, its face will squarely impact the portion of the next discharge plate 28 located below the lower edge 86 of the side cutout 72, and create the maximum rapping force to vibrate and dislodge the dust on that impacted plate. The exact same action occurs relative to the collector plates when a hammer of the collector hammer assembly 42 is dragged over the ledge edge 84 of a side cutout 70 in the hole 68 of a collector plate 30.

After the slotted square tube tracks 60 and 61 are mounted in the EP, the discharge drive rod 46 and the collector drive rod 47 together with their respective series of pivotally hung hammers is introduced at the front face of the precipitator and slid into its associated track 61 or 60. As seen in FIGS. 9 and 11, the front end of the discharge hammer rod 46 is secured by a threaded coupling 90 to a discharge rod mounting fitting 92 which is secured as by bolts to one end of the movable isolation insulator 56, the other end of which is rigidly secured, as by bolts to the motor drive fitting 50. The threaded coupling 90 permits lengthwise fine adjustments to the axial position of the rod 46 and its hammers. The front end of the collector discharge hammer rod 47 (see FIG. 11) is connected by a threaded coupling 94 to one end of a collector rod mounting fitting 96 which in turn is secured to the motor drive fitting 50 as by bolts. Similar to coupling 90, the threaded coupling 94 permits fine adjustment of the axial position of rod 47 and its hammers.

The piston shaft 51 of the pneumatic cylinder motor 52, when driven to the extended position of its stroke will axially drive both of the rods 46 and 47 and their hammers a distance equal to that necessary to move one hammer past and to successively impact a desired series of its associated plates (either collector or discharge plates). In the described example the predetermined number is to have each hammer moved past four plates and to impact four plates, and therefore if there are a total of 20 collector plates (and 19 discharge plates) there will be 5 hammers on each of the rods 46 and 47. The first and last plates will be impacted once and the intermediate plates in a properly designed system will be impacted twice when the reversing reciprocating pneumatic motor completes its forward and retracting stroke.

Secured to the motor drive connector bracket 50 via an angle bracket 98 is a slide foot 100 which during drive reciprocation, provides vertical slide support to the components secured on the end of the motor shaft 51.

The motor drive connection housing 48 is secured integrally with the EP front wall 44 and both of the hammer assemblies 40 and 42 extend at least to the rear wall 102 of drive housing 48. The track 61 of discharge assembly 40 passes through a hole 104 in housing wall 102 with sufficient clearance (similar to that described relative to the plates) between the edges of the hole and the assembly components to avoid arcing between the highly charged discharge assembly 40 and the grounded housing wall. The track 60 of the collector hammer assembly 42 can be secured to housing wall 102 by welding inasmuch as both are at ground potential.

The rods 46 and 47 are made from tubular steel, they could be made from solid bar stock if desired, but tubular rod is preferred. Also, the rods can be made as one integral rod of desired length, but the preferable construction is to make each complete rod from a plurality of joined segments, each segment of which can carry a pivotally hung hammer. Use of a segmented rod enables the hammer assemblies to be serviced and replaced if necessary from outside the precipitator by pulling the rod and removing and replacing one segment at a time if necessary. This results in a rapid repair or replacement and decreases down time on the precipitator.

Figure 5:
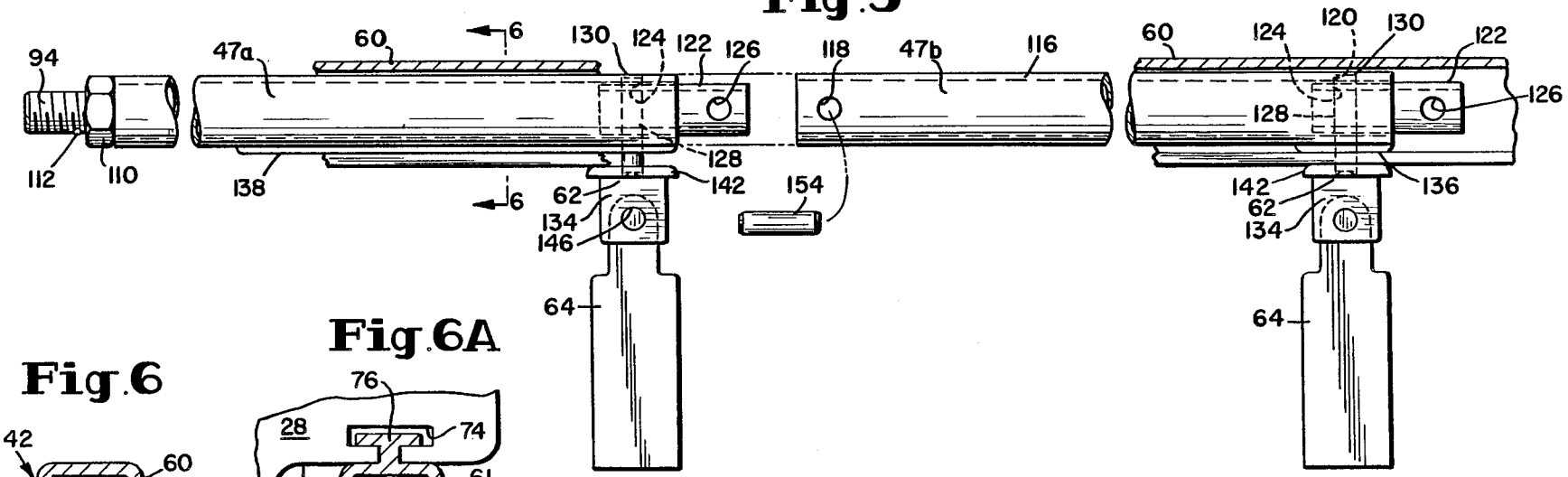
FIG. 5 is an enlarged, exploded and partially sectioned detailed view of part of a drag hammer assembly with square slotted track, and shows two of the tubular rod segments with a hammer pivotally hung from each segment.
Figure 6A:
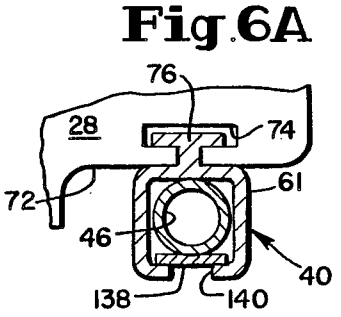
FIGS. 6 and 6*a* are section views, FIG. 6 being a section taken essentially at right angles to the assembly of FIG. 5 at section line 6—6, and FIG. 6*a* showing the equivalent section through a drag hammer track and rod for the discharge plates.
Figure 6:
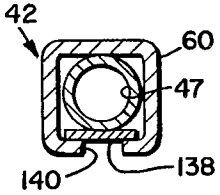
Figure 7:
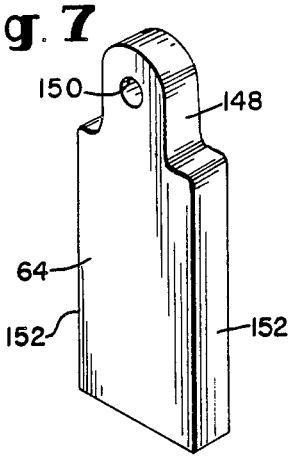
FIG. 7 is a perspective view of a hammer.
Figure 8:
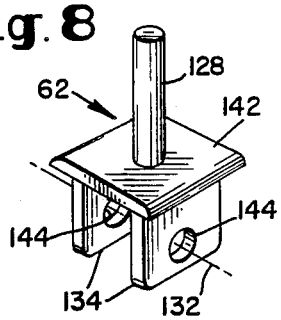
FIG. 8 is a perspective view of a hanger unit which pivotally carries a hammer.

The preferred segmented hammer assembly rod and the hammers and their pivotal hangers are illustrated in FIG. 5 with hammer and hanger details shown in FIGS. 7 and 8.

The drag hammer assembly 42 illustrated in FIG. 5 is the collector assembly 42 which includes the slotted square tube track 60. The primary difference between the two drag hammer assemblies is that discharge assembly 40 has the square tube track made with the T-channel strip 76 welded along its upper surface. Otherwise the segments, hangers, hammers and other components are identical.

FIG. 5 shows two of the tubular rod segments identified as 47*a* and 47*b*. Tubular segment 47*a* is a front end segment and at its left end has a nut 110 welded to the rod, enabling joinder of the rod to the motor drive fittings as by the threaded coupling 94 shown in FIG. 11. A weld spot 112 at the middle of the threaded coupling is used as an assembly indicator to assure that the coupling is sufficiently threaded into each of the coupled parts. The right hand end of segment 47*a* is identical with the right hand end of segment 47*b*.

A plurality of similar segments 47*b* are secured together in alignment and with a front segment 47*a* secured thereto will become the rod and hammer assembly for either the discharge assembly or the collector assembly. The front segment can be made of different lengths as desired to pre-locate the axial position of either the discharge or collector hanger rods.

Segments 47*b* are made from a predetermined length of steel tube 116 with a horizontal diametral through bore 118 adjacent the left end. Adjacent the right end is a vertical diametral through bore 120. Inserted into the right hand end is a short smaller diameter tubular coupling 122 which, adjacent its left hand end, has a diametral through bore 124 essentially the same size as bore 120 in pipe 116. Adjacent the right hand end of coupling 122 is a horizontal diametral through bore 126 essentially the same size as the horizontal bore 118 in the left hand end of the pipe segment 116.

A coupling 122 is placed into the right end of pipe segment 116 and rigidly secured in place by inserting a vertical stud 128 on top of a hammer hanger 62 up through the aligned vertical bores 120 and 124 of the pipe segment and coupling respectively. The stud 128 has a close fit with bores 120 and 124 and its upper end is welded 130 to the pipe 116, with the pivot axis 132 through the hanger clevis arms prepositioned to extend normal to the axis of pipe segment 116. Prior to assembly and welding of the hanger unit 62 to the pipe segment 116 a flat steel shoe 136 with an aperture is placed between the hanger 62 and the pipe segment 116 and over the hanger stud 128. Shoe 136 has a loose fit on the hanger stud 128 and serves as a slide guide between the rod 47 and the slotted lower side of the square tube track 60 or 61. A similar shoe 138 of greater length is assembled to the front end rod segment 47*a* because the tubular rod front end moves into and out of the end of the track at the front end of the assembly and the longer length of shoe 138 assures that the tubular rod does not contact the edges of the slot in the square track.

The diameter of the hammer hanger stud 128 is dimensioned to provide a free fit through the track slot 140. Stud 128 is rigid with a hanger cross piece 142 which is integral with the depending hanger clevis arms 134. Cross piece 142 in assembly on the pipe segment will fit under the slotted side of the square track and serves as a slide guide. The clevis ears are apertured with aligned holes 144 which receive a pivot pin 146 which is press fit into the clevis holes 144 to provide a secured pivot from which the pivotal drag hammer 64 will hang.

FIG. 7 shows the steel hammer 64 which has an apertured lug 148 on its upper end with the diameter of the lug aperture 150 dimensioned to result in a close free fit on the hanger pivot pin 146. The shape and weight of the hammer can be varied to achieve desired results for the EP's in which the drag hammer assemblies are used. Suitable weights for the hammer have been found to be from 2 to 5 pounds, a three pound weight being found to provide desired impact results in the example being described. The distance from the hammer pivot to the lower end can vary but it should be at least less than the spacing between two similar EP plates (i.e., two collector plates or two discharge plates) to enable the hammer to free fall from a position where it is dragged past a plate to the impact position against the next plate. Preferably the hammer shape should be such that its flat impact face 152 impacts the face of the impacted plate. However it has been found that even when an upper or lower edge of the flat face 152 strikes the impacted plate the force of the blow is sufficient to dislodge the dust and particles from the plate.

The aforedescribed pipe segment 47*b* and components assembled thereto consists of the pipe segment 47*b*, the short coupling 122 at its right hand end, a hanger 62 with a hanging hammer 64 and its upper stud 128 projecting through a shoe 136 and through aligned holes in the pipe segment 47*b* and coupling 122 and then welded to the pipe segment. A plurality of such assembled pipe segments and components can be axially aligned with and coupled to each other by telescoping the extended end of the attached coupling 122 into the left hand end of the tubular segment 116 and driving a coupling pin 154 with a press fit through aligned horizontal diametral bores 118 and 126 of the pipe 116 and coupling 122. The rod 47, pre-assembled, or segment by segment can be slid into the front end of the associated slotted square tube track with each shoe 136 placed over the slot 140 and inside of the track as the rod segments are placed into the track. Each segment can be coupled to the other as the segments are placed in the track or they can be completely assembled to each before the complete rod assembly is slid into the track.

It will be appreciated that the aforedescribed unique drag hammer assembly and its installation in a plate type EP permits many variations. The number of hammers used, relative to the number of collector or discharge plates, can be increased or decreased. For example, if the number of plates which are rapped by each hammer is decreased the required number of hammers will increase, which decreases the requisite stroke, and while one loses the advantage of minimized re-entrainment and emissions from the stack, a shorter pneumatic motor can be used. If desired, the drag rod segment length can be varied which will change the timing in the sequence of rapping. The drive motor can be an electric linear actuator, or motor driven gearing, such as a chain and sprocket arrangement. The hammer speed, weight, and frequency of cylinder drive stroke can be varied to adapt to different applications. Identical drag rod segments result in each hammer being spaced an equal predetermined distance apart and the resultant standardization of parts reduces cost. If an EP installation has several aligned modules, the drag hammer assemblies of the aligned modules can be aligned and interconnected through a coupling rod segment, similar to the other segments but without inclusion of a hammer, which can be whatever length is needed to connect the aligned drag hammer assemblies. In such case a single motor can drive all of the aligned interconnected drag hammer assemblies. The system is efficient and its cost is less than previously known systems and, having a minimum number of moving parts, is relatively easy to service.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An electrostatic plate type precipitator, including housing support structure, comprising: a plurality of alternately disposed, parallel, vertically arranged, and equally spaced apart discharge and collector plates in said housing support structure, said housing support structure having an inlet and outlet, enabling passage of gases in a path parallel with and between said plates, and having front and rear sides; means on said housing support structure supporting said plural discharge plates as a set and said plural collector plates as a set, with said sets electrically insulated from each other, said discharge plates being electrically insulated from said housing structure; an elongate drag hammer assembly, for each of the set of collector plates and the set of discharge plates, extending through the said plates normal to the parallel planes of said plates; each of said drag hammer assemblies including a drag rod means with two ends and a plurality of pivotally hanging hammers mounted on said drag rod means; means mounting said drag rod means for reciprocation back and forth relative to said plates and causing said hanging hammers to move in a reciprocable stroke past a selected number of said plates in the associated set of plates; means integral with the plates cooperating with associated hammers to raise each hammer upward as it moves past a plate and to permit the raised hammer to fall and strike the next adjacent plate of the associated set of plates; means mounting the one said elongate drag hammer assembly for the set of discharge plates in electrical isolation from the collector plates, the housing support structure and the other said drag hammer assembly; means mounting the other said elongate drag hammer assembly, the one for the set of collector plates, in electrical isolation from the set of discharge plates; and power means connected to both of the drag rod means to reciprocate said drag rod means and the hammers back and forth through their stroke.

2. A precipitator as defined in claim 1, wherein each drag hammer assembly includes an elongate track structure fixedly secured relative to said housing structure and extending through all plates associated with the drag hammer assembly, and each said drag rod means is slidably interconnected with its associate track structure to provide support of said drag rod means and enable its slidable reciprocation along the associated track structure.

3. A precipitator as defined in claim 2, wherein said associated track structure for the collector plate drag hammer assembly is rigidly secured to the housing structure adjacent the end ones of the collector plates.

4. A precipitator as defined in claim 3, wherein said track structure for the discharge plate drag hammer assembly and at least several of said discharge plates, including at least the end ones of said discharge plates, have interrelated cooperating support means which support said discharge drag hammer assembly track structure relative to said set of discharge plates; and first insulator means are rigidly secured to and between said discharge drag hammer assembly track structure and at least one side of said housing support structure to maintain said discharge hammer assembly track structure against axial movement normal to the plane of said plates.

5. A precipitator as defined in claim 4 wherein a common connector means couples a reciprocable drive component of said power means to one end of each of said drag rod means and a second insulator means provides a connection between and to said common connector means and said one end of the drag rod means for the discharge drag hammer assembly.

6. A precipitator as defined in claim 5 wherein said one ends of said drag rod means, both of said first and second insulator means and said power means are located at the exterior of the front side of said precipitator housing support structure and outside of the gas flow between said plates.

7. A precipitator as defined in claim 2 wherein each said track structure comprises a substantially horizontal tube with a slotted wall providing an axial slot extending the length of the tube and located, in assembly, at a lower part of the track structure; said drag rod means are slidably disposed in said tubes; said pivotally hanging hammers have hanger mounts projecting through the slot in the associated tube and are rigidly secured to and comprise part of the associated drag rod means, and each hanger mount includes a pivot connector carrying one of said hammers for pivotal movement about a pivot axis normal to the axis of the associated track structure and offset below the slotted wall of said associated tube.

8. A precipitator as defined in claim 7, wherein each said tube comprises a square tube with said axial slot in one of its sides.

9. A precipitator as defined in claim 7, wherein said track structure for the discharge plate drag hammer assembly includes an integral elongate T-channel extending along its exterior upper surface; and each of said discharge plates, which support said discharge plate drag hammer assembly, includes T-slot structure through which said T-channel is slidably disposed to provide at least a free sliding interfit for supporting the associated track structure from the discharge plates.

10. A precipitator as defined in claim 7, wherein the pivotally hanging hammers associated with one of said drag rod means are spaced apart a distance at least equal to the distance between a plural number of the plates with which the associated drag hammer assembly is associated.

11. A precipitator as defined in claim 10, wherein the hammers are mounted via the hanger mounts so that the spacing between two adjacent hammers on the same drag rod means is greater by a predetermined increment than the distance between a plural number of the plates with which the associated drag hammer assembly is associated; said predetermined increment being a fraction of the distance between two of the plates with which the drag hammer assembly is associated; and the length of the reciprocable stroke of the drag rod means is greater than the distance between adjacent hammers on the same drag rod means.

12. A precipitator as defined in claim 11, wherein the spacing between adjacent hammers on the same drag rod means is at least equal to the spacing between four collector plates or four discharge plates.

13. A precipitator as defined in claim 10, wherein each drag rod means comprises a tubular steel rod slidably disposed within its associated track tube.

14. A precipitator as defined in claim 13, wherein said drag rod means includes a plurality of tubular segments each of which has mounted thereon one of said hanger mounts with its associated pivotally mounted hammer; and a pair of two adjacent segments include interrelated releasable coupling means which secure said adjacent segments in axial alignment, said releasable coupling means being maintained in coupling cooperation by disposition of said adjacent coupled segments within the associated track tube.

15. A precipitator as defined in claim 1 wherein each hammer hangs from a pivotal mount, the axis of pivot being normal to the reciprocal direction of movement of the drag rod means and to a vertical plane through the axis of the drag rod means; each said hammer having dimension from its pivot axis to its lower end which is less than the distance between two collector plates so that as said hammer is dragged past one of its associated plates and raised to a substantial horizontal disposition before swinging free of that plate, its pivot axis will still be between adjacent ones of said associated plates permitting the said hammer, after being dragged past an associated plate, to swing down by gravity force and to impact the face of the next associated plate, at a location where the hammer has swung to approximately a bottom center of its arc of swing.

16. A precipitator as defined in claim 15, wherein the weight of each hammer is in the approximate range of from 2 to 5 pounds.

17. A precipitator as defined in claim 16, wherein the weight of each hammer is approximately 3 pounds.

18. A precipitator as defined in claim 1, wherein openings in all of said plates are shaped to enable both of said drag hammer assemblies to extend in spaced apart side-by-side relationship through said plates; said openings in the collector plates being aligned in a direction normal to the plates and shaped to permit passage of all components of the discharge plate drag hammer assembly therethrough with sufficient clearance at least equal to the spacing between adjacent discharge and collector plates; said openings in the discharge plates being aligned in a direction normal to the plates and shaped to permit passage of all components of the collector plate drag hammer assembly therethrough with sufficient clearance at least equal to the spacing between adjacent discharge and collector plates; the shape of the openings in all plates also permitting passage therethrough of the drag hammer assembly associated with the respective discharge and collector plates and each plate being provided with an edge portion providing an interference abutment engaged by one of said moving hammers associated with such plate to cause said hammer to pivot upward and when the hammer passes the interference abutment to permit the hammer to fall by gravity and swing into impact with a portion of the next associated plate which is located below its said interference abutment.

19. In an electrostatic plate type precipitator having a plurality of alternately disposed, parallel, vertically arranged, and equally spaced apart discharge and collector plates which are electrically insulated from each other, the improvement comprising an elongate rapping drag hammer assembly in association with the collector plates or the discharge plates so as to be projected through the said plates normal to the parallel planes of said plates; said drag hammer assembly including a drag rod means and a plurality of pivotally hanging hammers mounted in spaced apart relationship on said drag rod means; elongate means mounting said drag rod means for reciprocation back and forth along its axis and causing said hanging hammers to move in a reciprocable stroke for a distance equal to the spacing between a selected number of the collector plates; said plates having means to enable raising each hammer upward about its pivot axis and to permit the raised hammer to fall in an arc, about its pivot axis when the drag rod means is reciprocated.

20. The precipitator as defined in claim 19, wherein said elongate means is a track structure secured in the electrostatic precipitator extending through the plates of the precipitator and said drag rod means is slidably interconnected with its associate track structure to provide support of said drag rod means and enable its slidable reciprocation along the track structure.

21. The precipitator as defined in claim 20, wherein an insulator means is rigidly secured to said drag hammer assembly track structure to provide a mounting unit adapted to be secured to electrostatic precipitator structure.

22. The precipitator as defined in claim 21, wherein a second insulator means is rigidly secured to one end of the drag rod means and is adapted to be attached to a reciprocating member of a reciprocating power drive means.

23. The precipitator as defined in claim 20, wherein said track structure comprises a tube disposed horizontally to define an upper part and a lower part and has a slotted wall providing an axial slot extending the length of the tube and adapted to be located at the lower part of the track structure; said drag rod means is slidably disposed in said tube; said pivotally hanging hammers have associated hanger mounts projecting through the slot in said tube and are rigidly secured to and comprise part of the drag rod means, and each hanger mount includes a pivot connector carrying a hammer for pivotal movement about a pivot axis normal to the axis of the track structure and offset below the slotted wall of said tube.

24. The precipitator as defined in claim 23, wherein said tube comprises a square tube with said axial slot in one of its sides.

25. The precipitator as defined in claim 23, wherein said track structure includes an integral elongate T-channel extending along its exterior upper part.

26. The precipitator as defined in claim 23, wherein the pivotally hanging hammers on said drag rod means are spaced apart a distance at least equal to the distance between a plural number of the plates in the precipitator.

27. The precipitator as defined in claim 26, wherein the hammers are hung on said hanger mounts so that the spacing between two adjacent hammers on the drag rod means is greater by a predetermined increment than the aforesaid distance between a plural number of the plates; said predetermined increment being a fraction of the distance between two of the plates in the precipitator.

28. The precipitator as defined in claim 26, wherein said drag rod means comprises a tubular steel rod slidably disposed within its associated track tube.

29. The precipitator as defined in claim 28, wherein said drag rod means includes a plurality of tubular segments each of which has mounted thereon one of said hanger mounts with one of said pivotally mounted hammers; and a pair of two adjacent segments include interrelated releasable coupling means which secure said adjacent segments in axial alignment, said releasable coupling means being maintained in coupling cooperation by disposition of said adjacent coupled segments within said track structure.

30. The precipitator as defined in claim 20, wherein the weight of each said hammer is in the approximate range of from 2 to 5 pounds.

31. The precipitator as defined in claim 30, wherein the weight of each said hammer is approximately 3 pounds.

* * * * *